US005560376A

United States Patent [19]

Meiring et al.

[11] Patent Number: 5,560,376

[45] Date of Patent: Oct. 1, 1996

[54] METHOD OF AND APPARATUS FOR ADJUSTING THE MOISTURE CONTENT OF A FUEL COMPONENT FOR A SMOKING ARTICLE

[75] Inventors: Robert L. Meiring, Winston-Salem; Vernon B. Barnes, Advance, both of N.C.

[73] Assignee: R. J. Reynolds Tobacco Company, Winston-Salem, N.C.

[21] Appl. No.: 369,018

[22] Filed: Jan. 5, 1995

[51] Int. Cl.[6] ..... A24B 15/00

[52] U.S. Cl. ..... 131/369; 131/304; 44/535; 34/443

[58] Field of Search ..... 131/194, 359, 131/369, 300, 304; 44/535, 500, 504; 34/443, 507, 236

[56] References Cited

U.S. PATENT DOCUMENTS

| | | | |
|---|---|---|---|
| 1,751,472 | 3/1930 | Criqui | 34/443 |
| 3,355,814 | 12/1967 | Geske | 34/443 |
| 3,407,510 | 10/1968 | Lewis et al. | 34/443 |
| 4,676,006 | 6/1987 | Tolson | 34/443 |
| 4,732,168 | 3/1988 | Resce et al. | 131/194 X |
| 4,898,189 | 2/1990 | Wochnowski | 131/300 X |
| 5,062,217 | 11/1991 | Tolson | 34/443 |
| 5,247,947 | 9/1993 | Clearman et al. | 131/194 |
| 5,469,871 | 11/1995 | Barnes et al. | 131/194 |

FOREIGN PATENT DOCUMENTS 0562474 9/1993 European Pat. Off. .

*Primary Examiner*—Jennifer Bahr

[57] ABSTRACT

A method of and apparatus for adjusting and controlling the moisture content of carbonaceous fuel components used in making smoking articles comprises a mass flow accumulator and a dryer through which the fuel components are conveyed. Unheated air is flowed over the fuel components in the accumulator to adjust and maintain the moisture content of the fuel components to a level which permits cutting of the fuel components without chipping or cracking. After the fuel components are cut into individual fuel elements and combined with an aerosol generator or substrate they are conveyed through the dryer where heated air is flowed over them to further reduce the moisture content to a desired level for further processing and manufacture into smoking articles.

25 Claims, 8 Drawing Sheets

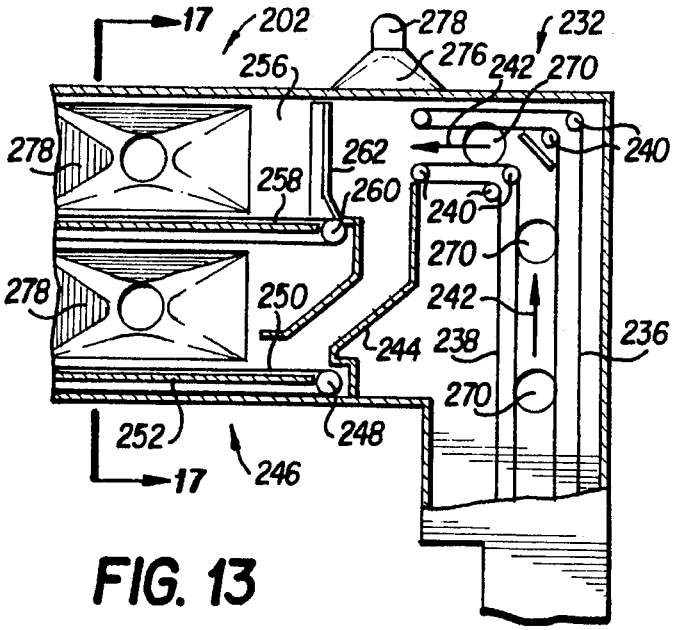
FIG. 13
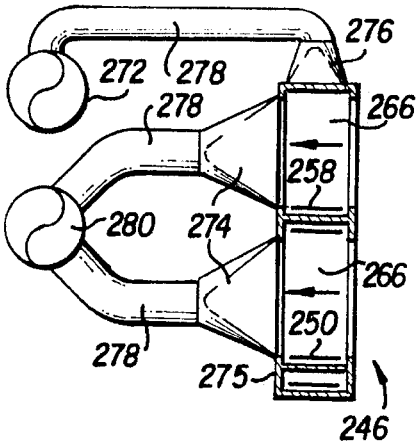
FIG. 17
FIG. 15
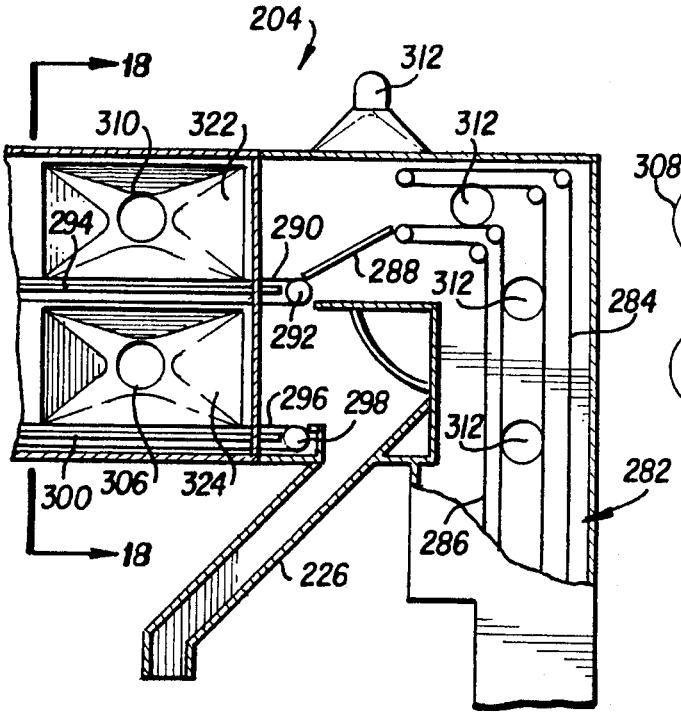
FIG. 18
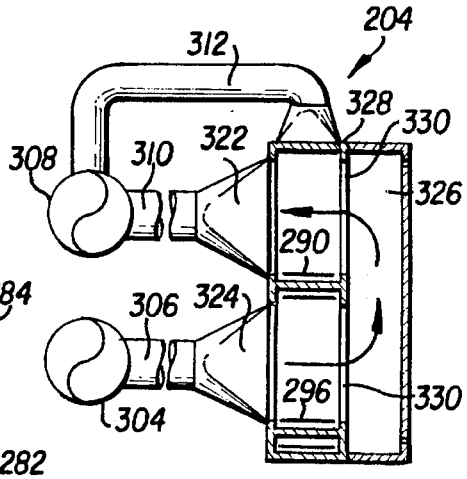

METHOD OF AND APPARATUS FOR ADJUSTING THE MOISTURE CONTENT OF A FUEL COMPONENT FOR A SMOKING ARTICLE

FIELD OF THE INVENTION

The present invention relates to drying apparatus and methods and more particularly to a method of and an apparatus for adjusting and controlling the moisture content of a carbonaceous fuel element used in the manufacture of smoking articles, such as cigarettes.

BACKGROUND OF THE INVENTION

Recent improvements in smoking articles, such as cigarettes, include cigarettes of a type having a fuel component, a physically separate aerosol generator or substrate and a separate mouthpiece component. See, e.g., U.S. Pat. No. 4,714,082 assigned to the assignee of this invention. Apparatus and processes for mass producing such improved cigarette smoking articles are disclosed, for example, in U.S. patent application Ser. No. 089,502 filed Jul. 16, 1993 and U.S. patent application Ser. No. 856,239 filed Mar. 25, 1992, both assigned to the assignee of the present invention and the disclosures of which are incorporated herein by reference.

In the manufacture of such cigarettes, the fuel component includes an extruded carbonaceous fuel element which is circumscribed by a resilient insulating jacket, such as a mat or layer of glass fibers, and is then overwrapped with a cigarette paper or paper-like material and glued, e.g., with a cold adhesive seal, along a longitudinal seam, to form a continuous cylindrical fuel rod. The continuous overwrapped fuel rod may then be cut into shorter lengths to form fuel components suitable for processing, e.g., a six-up fuel rod having a length of about 72 mm.

The aforesaid U.S. patent application Ser. No. 856,239 describes one known process for mixing and extruding the continuous carbonaceous fuel rod, circumscribing the rod with a resilient glass fiber jacket or layer, overwrapping the rod with a paper overwrap and cutting the rod into predetermined lengths for subsequent cutting into fuel elements for individual smoking articles. In that process, the rod extrudate still has a relatively high moisture content in the range of about 30% to 40% by weight at the time it is circumscribed by the jacket and overwrapped with paper. It is to be understood that percentages of moisture content referred to hereinafter are intended to be wet weight percent unless otherwise stated. Drying is accomplished according to the described process while the extruded fuel rod is in situ in the overwrapped fuel component during subsequent processing so that no specific drying apparatus is used or required.

According to the aforesaid U.S. patent application Ser. No. 089,502, drying of the fuel element may be accomplished after the extruded fuel rod is overwrapped and cut into predetermined lengths or at other stages of the cigarette manufacturing process. Several possible drying apparatus are disclosed, including passive dryers such as a timed accumulator system, e.g., a Resy accumulator available from Körber & Co., AG, of Hamburg, Germany (hereinafter "K örber") or an S-90 accumulator available from G. D. Societe per Anzioni of Bologna, Italy (hereinafter "GD") or active dryers, such as a hot air blowing system. It is also suggested in that application that the drying stages may be eliminated and relocated since the moisture content of the extruded fuel rod depends on the initial moisture content of the rod and the time lapse between the different stages in the manufacturing process.

It has been found that when the moisture content of the extruded rod is in the relatively high 30% to 40% range, after applying the jacket and overwrap paper to the rod, the moisture in the rod will migrate into the resilient jacket material and the overwrap paper. If that migrated moisture is not removed from the jacket and overwrap, it may cause one or more of several problems to occur, namely, a circumferential enlargement or "swelling" of the overwrapped fuel component, a loosening or failure of the longitudinal adhesive seam of the fuel rod component, or discoloration of the overwrap material. In the event the fuel component enlarges or "swells" circumferentially, downstream processing of the fuel component will be adversely affected.

It has been further found that drying of the extrudate fuel rod to a relatively low moisture content to prevent the aforesaid problems that occur with a high moisture content can also cause problems with processing of the fuel component. For instance, if the overwrapped six-up fuel component has too low a moisture content, i.e., is too dry, the extruded rod tends to fracture or chip when the six-up fuel component is cut into individual fuel elements for assembly into cigarette smoking articles.

It would be desirable therefore to provide a method of and an apparatus for adjusting the moisture content of the carbonaceous fuel element to appropriate levels during assembly of the smoking articles to eliminate the aforementioned problems with fuel components having a moisture content that is either too high or too low at a given stage of processing.

SUMMARY OF THE INVENTION

The present invention is directed to a method of and an apparatus for controllably adjusting the moisture content of a fuel component for smoking articles comprising an extruded carbonaceous fuel rod circumscribed with a resilient jacket, overwrapped with paper or a paper-like material and sealed along a longitudinal seam to form a continuous fuel rod which is then cut into individual fuel components. The extruded carbonaceous fuel rod advantageously has a relatively high moisture content for optimum extrusion characteristics. Typically, the moisture content of the extruded carbonaceous rod is in the range of 30% to 40% by weight. After the extruded fuel rod is jacketed, overwrapped, sealed and cut into fuel components of a predetermined length, e.g., a six-up rod having a length of about 72 mm, the overall moisture content of the extruded fuel rod may be, for example, in the range of about 30% to 36%.

The moisture content of the overwrap paper must be maintained relatively low, preferably in the range of about 6% to about 18%, and most preferably at the lower end of that range, e.g., about 8% to 12%. Should moisture content of the overwrap paper exceed about 18%, the overwrapped fuel component will swell circumferentially to a degree that may cause subsequent transporting and processing problems. Accordingly, the moisture content of the overwrap paper must be maintained relatively low during the entire time it is overwrapped about the high moisture content extruded fuel rod. On the other hand, the moisture content of the extruded fuel rod must be maintained above a certain minimum value for reasons that will be explained hereafter.

After overwrapping, the fuel components are accumulated in a mass flow accumulation system, such as a conventional Resy accumulator modified according to the present invention to maintain the moisture content of the overwrap paper in the approximate range of 6% to 18% to prevent the paper from swelling, splitting or discoloring. This is accomplished in the accumulator by drawing unheated ambient air over the six-up fuel components at a rate sufficient to remove enough moisture to maintain the moisture content of the paper below 18%, but not sufficient to reduce the moisture content of the extruded carbonaceous rod below about 20%. Preferably, the moisture content of the extruded rod is maintained at a moisture content of about 22% to 30%. Under some conditions or with different fuel component configurations, it may be desirable or necessary to heat the ambient air to maintain the appropriate moisture content.

The overwrapped six-up fuel component can usually be successfully cut without fracturing or chipping the extruded rod if the moisture content of the rod is above about 18%. However, the preferred range of moisture content of the extruded rod for cutting the six-up fuel components in the 22% to 30% range. Of course, the higher the moisture content in that range the more easily the fuel component can be cut without fracturing or chipping the extruded rod. Since the composition of the carbonaceous fuel rod may vary substantially, so also will the range of moisture content of the extruded rod that is most advantageous or optimum for accumulating and processing the fuel components and for cutting the fuel components into individual fuel elements suitable for attachment to a separate aerosol generator or substrate.

The accumulator supplies the six-up (72 mm long) fuel components to a tipping apparatus, such as a Max R-1 or Max 2 tipper available from Körber, where each component is cut into six lengths of about 12 mm each to form six jacketed fuel elements, which are then combined with substrates on a drum in the tipper to form two-up fuel element/substrate sections approximately 86 mm in length. Each fuel element/substrate section comprises, e.g., two 12 mm fuel elements affixed to the opposite ends of a 62 mm two-up substrate. As previously mentioned, the moisture content of the extruded rod when it is cut in the tipper is preferably in the range of about 22% to 30% to prevent chipping and fracturing of the rod and is preferably toward the high end of that range, e.g., 25% to 30%, while the moisture content of the overwrap paper is maintained in the 6% to 18% range.

After the individual fuel elements are combined with the two-up substrates in the tipper, the resultant fuel element/substrate sections are then transferred to a dryer apparatus where they are contacted with heated ambient air to remove additional moisture from the extruded fuel rod and reduce the difference in the moisture content between the overwrap paper and the extruded rod.

The temperature of the heated ambient air supplied to the dryer apparatus is preferably in the range of 110° F. to 120° F., but may be as high as 150° F. to 160° F. without adversely affecting the handling and transporting characteristics of the fuel element/substrate sections. The dryer apparatus may also be a conventional Resy accumulator modified according to the present invention to introduce heated ambient air across the flow path of the fuel element/substrate sections as they pass through the apparatus from inlet to outlet. Temperature and flow rate of the heated air may be adjusted to achieve the desired final moisture content of the fuel element/substrate sections and to reduce the moisture content difference between the fuel elements and the substrate sections.

After passing through the dryer apparatus, the two-up fuel element/substrate sections may be transferred to an HCF tray filler, or to a mass flow conveyor for further assembly into smoking articles as described more fully in the aforementioned U.S. patent application Ser. No. 089,502. As will be more fully described, the method and apparatus of the present invention are capable of advantageously maintaining and adjusting the moisture content of the two primary parts of the fuel component, namely, the extruded fuel rod and the overwrap paper, to appropriate levels to optimize the conditions for processing and transporting the fuel component and the combined fuel component/substrate sections.

Two embodiments of the apparatus of the invention are disclosed, namely, a first embodiment in which four blowers or fans and two air heaters are used to supply and exhaust heated air to and from the dryer apparatus, and a second embodiment of less complex construction in which only two blowers or fans and one air heater are used to supply and exhaust heated air to and from the dryer apparatus. The second embodiment also utilizes a more simplified system for drawing unheated air over the overwrapped fuel component in the mass flow accumulator section of the apparatus.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 13 is a fragmentary cross-sectional elevation view of the inlet portion of the mass flow accumulator section of the FIG. 12 second embodiment of the invention;

FIG. 15 is a fragmentary cross-sectional elevation view of the inlet portion of the dryer section of the FIG. 12 second embodiment;

FIG. 17 is a cross-sectional view of the mass flow accumulator section taken along line 17—17 of FIG. 13; and FIG. 18 is a cross-sectional view of the dryer section taken along line 18—18 of FIG. 15.

DETAILED DESCRIPTION OF THE INVENTION

Figure 1:
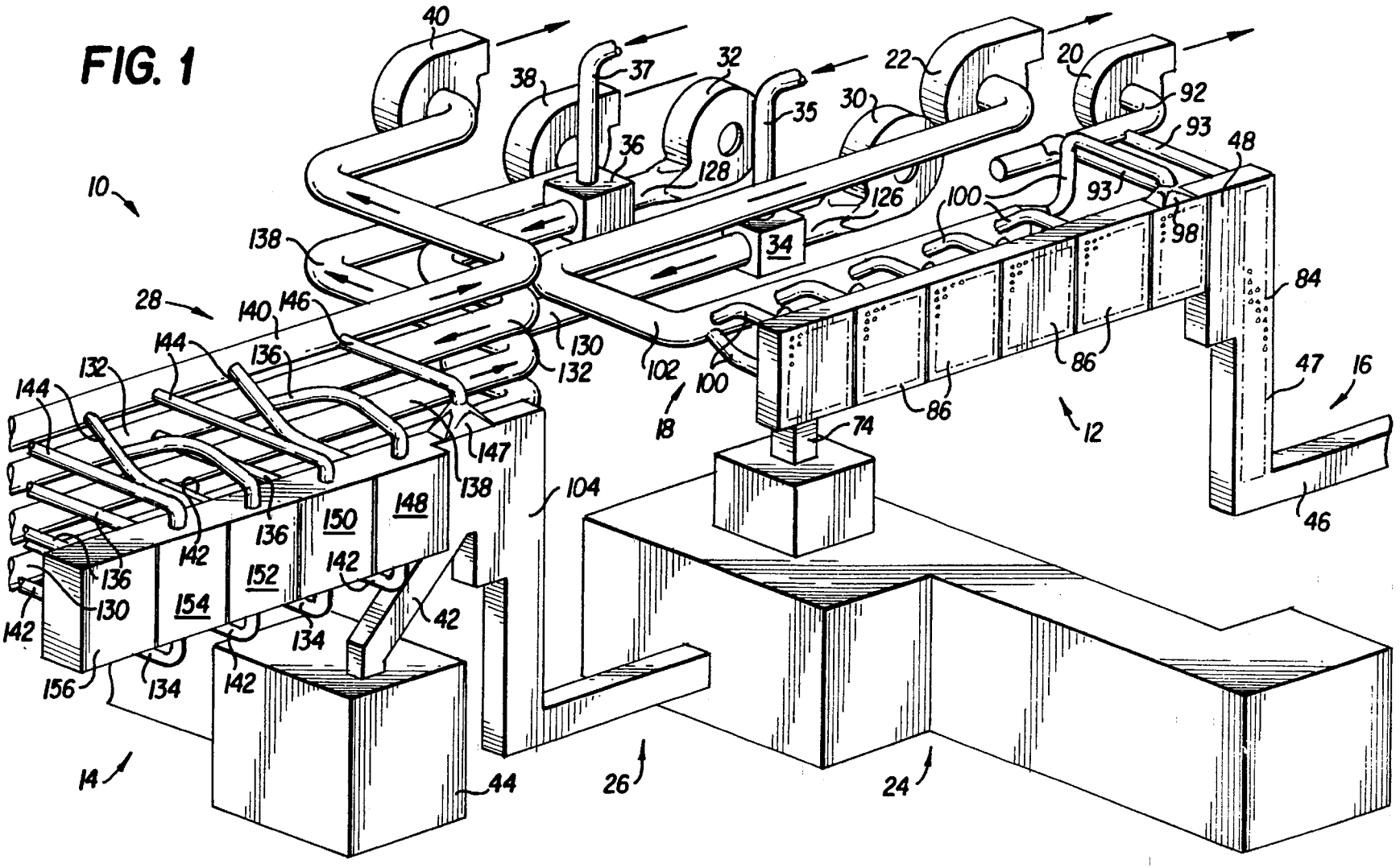
FIG. 1 is a perspective view of a first embodiment of the entire apparatus of the invention.

Referring now to the drawings, FIG. 1 illustrates the first embodiment of the moisture adjusting and drying apparatus 10 of the present invention associated with other components of the equipment used to manufacture smoking articles of the type disclosed in the aforesaid U.S. patent application Ser. No. 089,502. The apparatus 10 is constructed in two sections designated generally by reference numerals 12 and 14. The first or upstream section comprises a moisture adjusting accumulator 12, such as a Resy mass flow accumulator modified in accordance with the present invention. The second or downstream section of the apparatus 10 comprises a hot air drying section 14, such as another Resy mass flow accumulator also modified in accordance with the invention.

The first section 12 includes an input conveyor section 16 which is connected to an upstream apparatus (not shown) for supplying fuel components to the apparatus 10 for processing. The fuel components may be supplied, for example, from the output of the equipment disclosed in the aforementioned U.S. patent application Ser. No. 856,239 which output comprises an extruded carbonaceous fuel rod circumscribed with a resilient glass fiber layer, then overwrapped with a layer of paper or paper-like material and sealed along a longitudinal seam. This fuel rod is then cut into six-up fuel components which are deposited on the input conveyor 16, with the longitudinal axes of the fuel components arranged transversely to the direction of travel of the conveyor 16.

The first section 12 is connected via ambient air manifold piping 18 to a pair of blowers or fans 20, 22 which draw ambient air through the first section and over the fuel components therein as more fully explained hereinbelow. In most cases, the ambient air is unheated, however, it may be desirable or necessary to heat the air. From the first section or moisture-adjusting accumulator 12 the fuel components are transported to a tipping apparatus 24, such as a Max R-1 or Max-2 tipper where they are cut into individual fuel elements which are then combined two each with a two-up aerosol generator or substrate, as described in the aforementioned U.S. patent application Ser. No. 089,502, and conveyed as two-up fuel element/substrate units to the outlet conveyor 26 of the tipper 24.

Outlet conveyor 26 also comprises the inlet conveyor for the second section or hot air dryer section 14 of the apparatus 10. The second section 14 may be a Resy accumulator modified to form a flow path of sufficient length to provide the required residence time for drying of the fuel components. The second section 14 is connected via hot air manifold piping 28 to two blowers or fans 30, 32 and heaters 34, 36 which supply heated ambient air to the second section 14. Heaters 34, 36 are supplied with steam for heating purposes via steam inlet lines 35, 37 from a source (not shown). Other heating sources, e.g., electrical heaters, may be used. Drying air is heated to a temperature in the range of about 110° F. to 160° F., and preferably to about 120° F. Two additional blowers or fans 38, 40 exhaust heated air from the second section 14. Such heated air carries along in the form of water vapor a substantial portion of the moisture content contained in the extruded fuel rods of the two-up fuel element/substrate units passing through the second section 14.

During passage of the two-up fuel element/substrate units through the second section 14, the difference in moisture content between the fuel element and the substrate is further reduced. The units may then be conveyed via a discharge chute 42 to, for example, an HCF tray filler 44 or to a conventional Resy accumulator or directly to cigarette making machinery as described in U.S. patent application Ser. No. 089,502. Eventually, the difference in moisture content between the fuel element and substrate will become zero or substantially zero, i.e., the moisture content of the fuel element/substrate combination will be equilibrated at a level that is in the desired range for packaging the completed cigarettes.

Now referring to FIGS. 2, 3, 4 and 7, the construction and operation of the first section 12 of the apparatus 10 will be described. The inlet conveyor 16 comprises lower and upper horizontal conveyor portions 46, 48 and a vertical conveyor portion 47. Conveyors 46, 47, 48 are formed by a pair of opposed conveyor belts 50, 52 each trained about a plurality of guide pulleys 54, one or more of which are driven by motors (not shown) so as to advance the fuel component product disposed between the confronting runs of the conveyor belts 50, 52 in the direction of the horizontal and vertical arrows 56. It will be appreciated by those skilled in the art that the longitudinal axes of the fuel component rods are arranged transversely to the direction of travel of the belts 50, 52, i.e., substantially parallel to the rotational axes of the pulleys 54.

From the upper horizontal portion 48 of the inlet conveyor 16, the fuel component product flows downwardly through a receiving chute 58 as shown by the directions of arrows 60, 62 and onto a lower horizontal conveyor belt 64 which is trained about pulleys 66, at least one of which is driven by a motor (not shown). The upper horizontal run 68 of the conveyor belt 64 is guided over a stationary plate member 70 so as to support the mass of fuel component product carried downstream by the conveyor belt 64 in the direction shown by the arrows 72. At the downstream end of the conveyor 64, the fuel component product passes downwardly through a discharge chute 74 to the tipping apparatus 24 (FIG. 1).

The upper portion of the mass flow section 17 comprises an accumulator bank 76 with an upper horizontal conveyor belt 78 trained about pulleys 79 and a movable pusher member 80 which moves back and forth in the directions shown by the arrow 82. Movement of the pusher member 80 toward the downstream end of the mass flow section 17, i.e., to the dashed line position designated with reference numeral 80', will accumulate the fuel component product on the upper conveyor 78, for example, when product flow downstream of the first section 12 is stopped or interrupted for any reason. When flow resumes, the pusher member 80 moves from position 80' toward its position at the upstream end of the upper conveyor belt 78.

Figure 2:
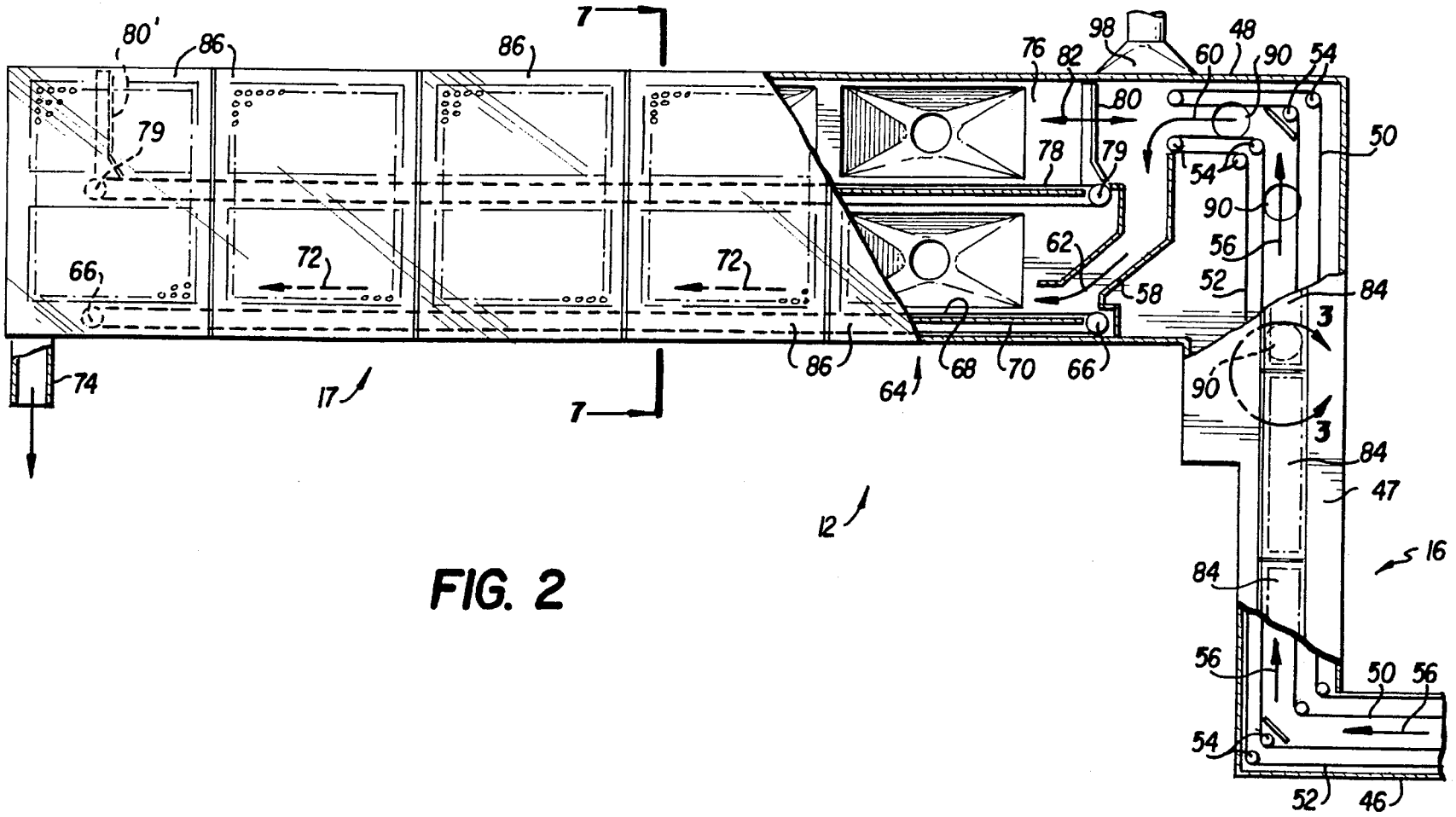
FIG. 2 is a front elevation view, partly in cross-section, of the mass flow accumulator section of the first embodiment of the apparatus of the invention.
Figure 5:
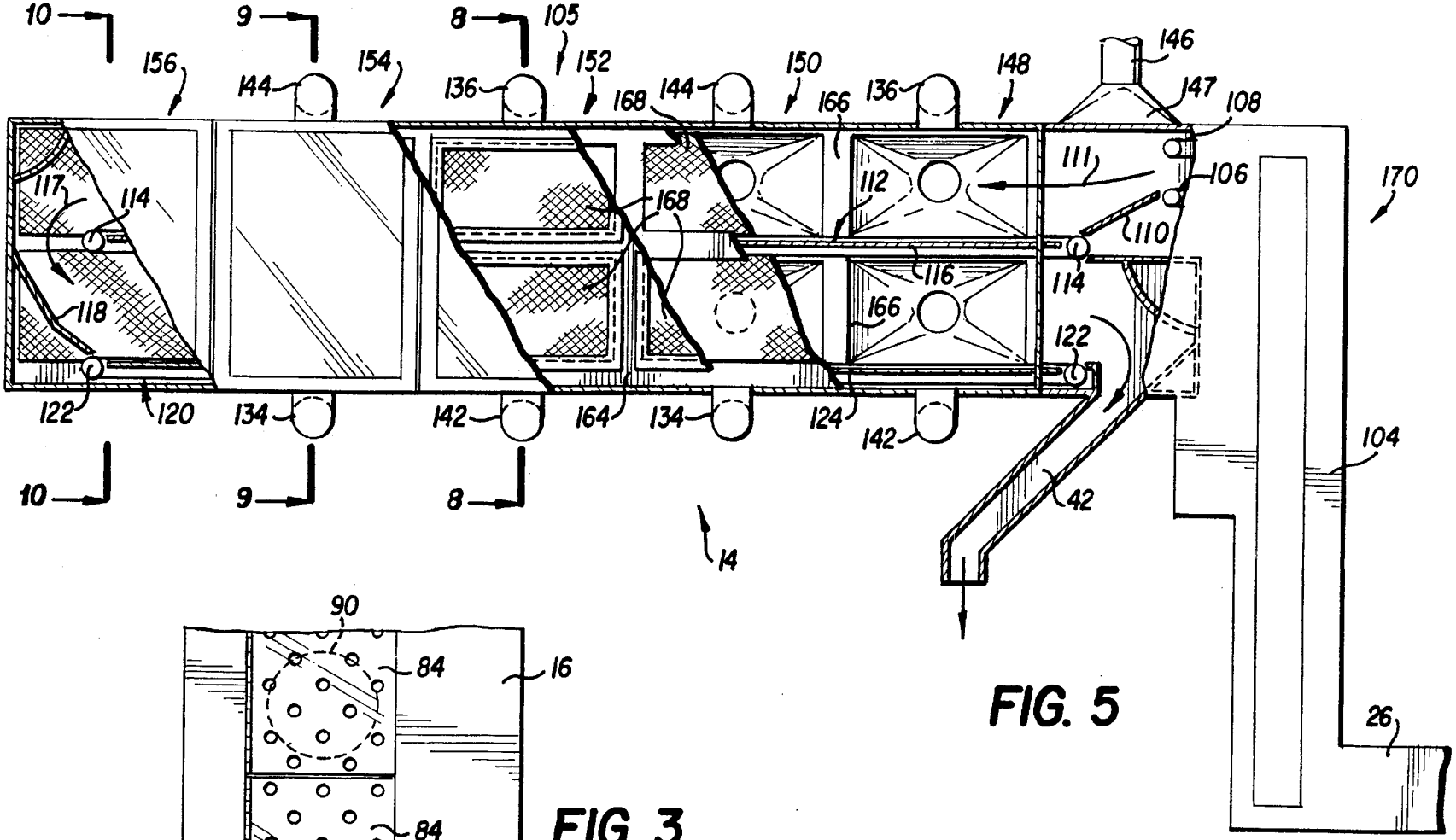
FIG. 5 is a front elevation view, partly in cross-section, of the dryer section of the apparatus of the invention.
Figure 3:
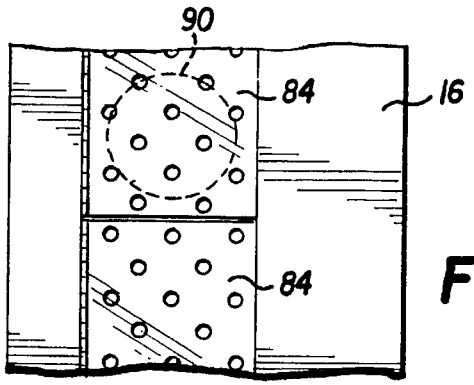
FIG. 3 is a detail of the input conveyor of the mass flow accumulator section shown in FIG. 2.
Figure 4:
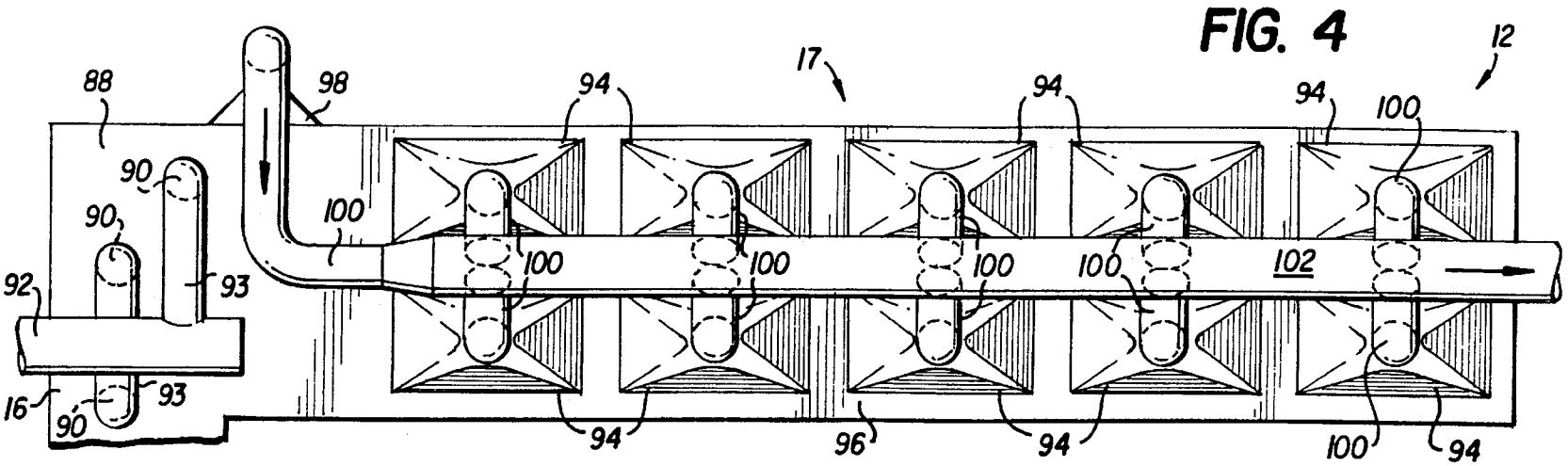
FIG. 4 is a rear elevation view showing the exhaust ducts for the mass flow section.
Figure 6:
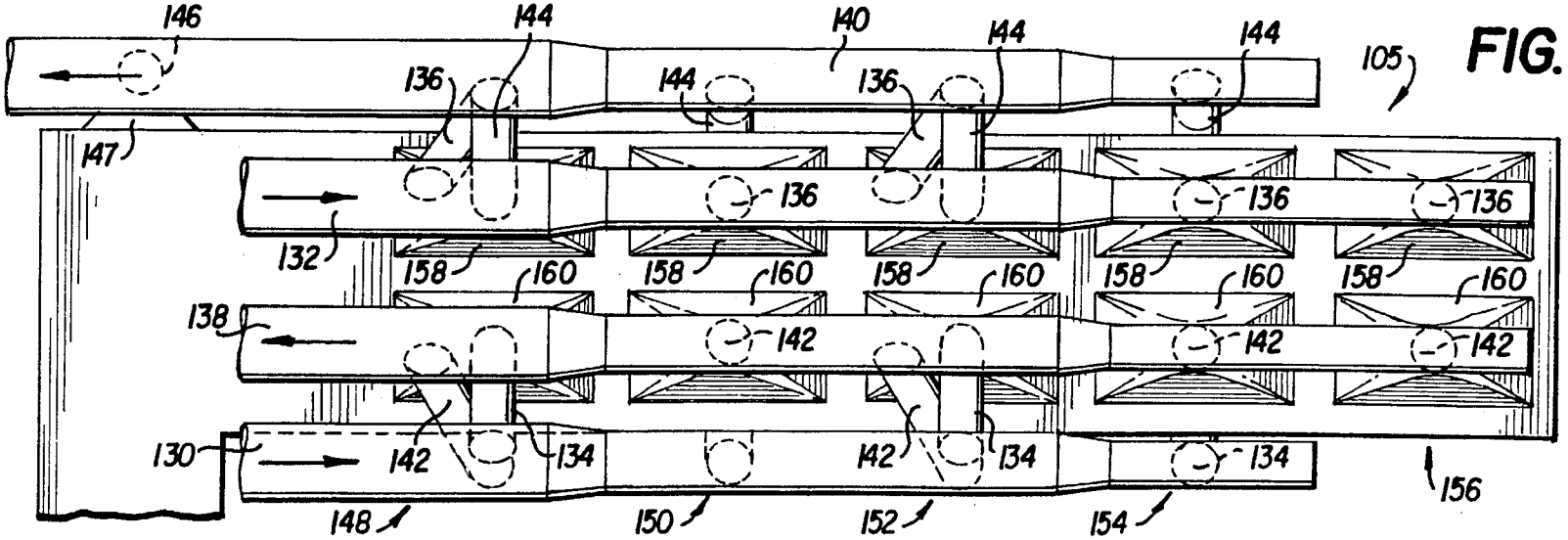
FIG. 6 is a rear elevation view showing the heated air and exhaust ducts for the dryer section.
Figure 7:
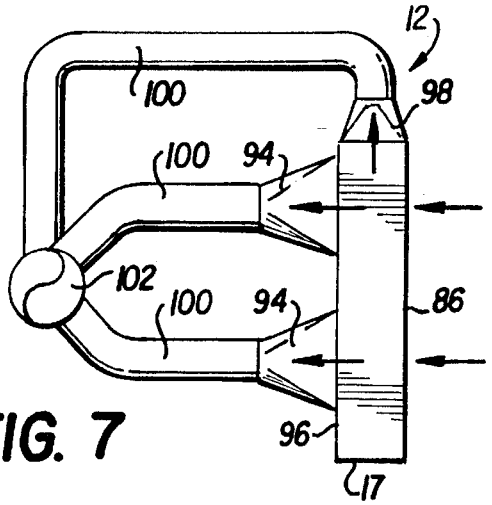
FIG. 7 is a cross-sectional view of the mass flow section taken along line 7—7 of FIG. 2.

As shown in FIGS. 2 and 3, the from surfaces of the input conveyor section 16 and the mass flow section 17 are provided with perforated plates or screens 84, 86 to permit the inflow of ambient air into the sections 16, 17. Such air flow is generated by blowers 20, 22 creating a suction in air manifold piping 18 which is connected to the sections 16, 17 in the piping arrangement shown in FIGS. 1, 4 and 7.

Attached to the rear wall 88 of the input conveyor section 16 is a plurality of suction openings 90 which are connected via ducts 92, 93 to blower 20 so as to draw ambient air through perforated plates 84 across the fuel component product in the input conveyor section 16. The capacity of blower 20 is about 1500 to 1600 cfm but may be adjusted by blower motor speed control or by dampers (not shown) to a desired flow rate depending on the throughput of the apparatus, the moisture content of the extruded fuel rod in the incoming fuel component product and the desired moisture content of the fuel component at the discharge chute 74 of the first section 12.

A plurality of funnel-shaped duct fittings 94 are secured to the rear wall 96 of mass flow section 17 and one funnel-shaped duct fitting 98 is secured to the top of the mass flow section at the outlet or discharge of the upper horizontal conveyor 48 of the input conveyor section 16. Each of the fittings 94, 98 is connected by individual piping 100 to a main suction duct 102 which is, in turn, connected to blower 22. Blower 22 draws ambient air through the perforated plates 86 of the mass flow section 17 and across the fuel component product disposed therein in the direction shown by the arrows in FIG. 7. Blower 22 has a capacity similar to that of blower 20 and may be adjusted in the same manner as blower 20.

When the six-up fuel components arrive at the lower horizontal conveyor 46 of the input conveyor 16, the moisture content of the extruded carbonaceous fuel rod contained in the fuel component product is relatively high, e.g., about 30% to 40%, and the moisture content of the circumscribing resilient layer and paper overwrap is relatively low, e.g., in the 6% to 18% range, and preferably about 8% to 12%. To avoid any excessive migration of moisture from the extruded fuel rod to the overwrap while at the same time maintaining a relatively high moisture content of the fuel rod to insure ease of cutting the rod during further processing downstream, unheated ambient air is used in the first section 12. The flow rate of the unheated air is adjusted in relation to the throughput of fuel component product and the initial moisture content of the extruded rod so that (1) the moisture content of the overwrap paper is maintained below about 18% to avoid swelling problems and (2) the moisture content of the extruded rod does not fall below about 18% and preferably is maintained at about 22% to 30% for optimum cutting.

Referring again to FIG. 1, after the six-up fuel components are discharged from the first section 12 through discharge chute 74, they are received in the tipping apparatus 24 where they are each cut into six fuel elements of equal length. Each pair of fuel elements is positioned with one element at opposite ends of a substrate unit and the combination is overwrapped with tipping paper to form a two-up fuel element/substrate unit which exits the tipper 24 and passes to the outlet conveyor 26. Assembly of the two-up fuel element/substrate units is described in greater detail in U.S. patent application Ser. No. 089,502.

Referring now to FIGS. 5, 6 and 8–11, the construction and operation of the second section or hot air drying section 14 of the apparatus 10 will be described. From the outlet conveyor 26 of the tipper apparatus 24, the two-up fuel element/substrate units are conveyed by an inlet conveyor 104 similar to input conveyor 16 to the dryer section 105 of the second section 14 where they are discharged from between the conveyor belts 106, 108 of the inlet conveyor onto an inclined support plate 110. The units flow down support plate 110 in the direction of arrow 111 onto the upper run of a conveyor belt 112 located in the upper part of the dryer section 105. Conveyor belt 112 is trained between a pair of pulleys 114 at least one of which is driven by a motor (not shown). The upper conveyor run is guided over a stationary support plate 116 so as to support the mass of fuel element/substrate units thereon.

At the downstream end of the upper conveyor 112, the units flow downwardly as shown by arrow 117 into the lower part of the dryer section 105, over inclined plate 118 and onto the upper run of a lower conveyor belt 120 which is trained about pulleys 122 at least one of which is motor-driven. Like conveyor 112, the upper run of conveyor 120 is guided over a stationary support plate 124. In the dryer section 105, no accumulator section is provided as in the mass flow section 17 of the first section 12. Accordingly, all the product, in this case, the two-up fuel element/substrate units, flows along both conveyors, first over conveyor 112 from right to left as viewed in FIG. 5 and then over conveyor 120 from left to right as viewed in FIG. 5.

At the downstream end of conveyor 120, the units are guided down inclined discharge chute 42 from which they are discharged into an HCF tray filler 44 (FIG. 1 ). It will be appreciated by those skilled in the art that during operation of the apparatus 10, the fuel components and fuel element/substrate units substantially fill the internal spaces of the dryer section 105 over the conveyors 112, 120 and at least the lower portion of the mass flow section 17 over conveyor 64 and the inlet conveyors and discharge chutes.

Heated air is flowed over the units passing through the second section 14 by means of the hot air manifold piping 28, blowers 30, 32, 38, 40 and heaters 34, 36 in the following manner. Blowers 30, 32 intake ambient air and discharge it into main ducts 126, 128 from which it passes through heaters 34, 36 where it is heated to a temperature in the range of 110° F. to 160° F., and preferably about 120° F. From heaters 34, 36, the heated air flows through main hot air ducts 130, 132 and into smaller hot air supply ducts 134, 136 which are connected to the dryer section 105 in the manner described below. Exhaust blowers 38, 40 are connected to the dryer section 105 by main hot air exhaust ducts 138, 140 and smaller hot air exhaust ducts 142, 144, 146. The blowers 30, 32, 38, 40 have the same capacity as the blowers 20, 22 (1500 cfm to 1600 cfm) and, like the blowers 20, 22, may be adjusted by a motor control or by dampers.

The dryer section 105 has five drying zones 148, 150, 152, 154, 156 into which the heated air is introduced and exhausted. It has been found that more uniform distribution of the heated air and consequently a more uniform drying of the fuel element/substrate units can be achieved by alternately passing the heated air along the units first from one end and then from the other end. This is accomplished by appropriate connection of the hot air supply and exhaust ducts to the five drying zones 148–156.

Each drying zone is provided at the rear of the dryer section 105 with a pair of funnel-shaped duct fittings 158, 160 which confront the product supported on conveyor belts 112, 120 respectively. The front of the dryer section 105 is provided with a plenum 162 that extends the entire length of the five drying zones.

Figure 8:
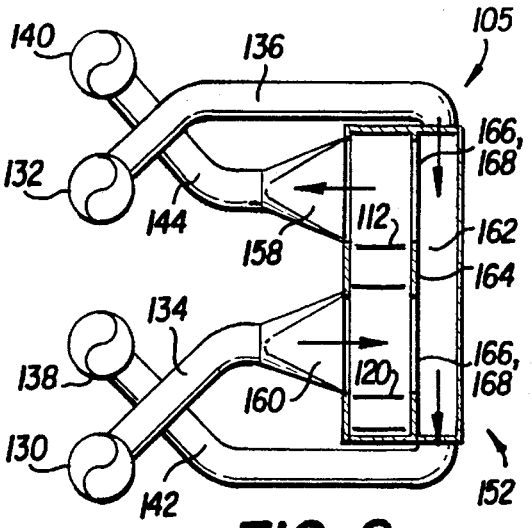
FIGS. 8–10 are cross-sectional views of the dryer section taken along lines 8—8, 9—9 and 10—10 of FIG. 3.

In the first and third drying zones 148, 152, heated air from main hot air duct 132 enters the plenum 162 via ducts 136 (FIG. 8), passes through the product on conveyor 112 from front to back and is exhausted through fittings 158, ducts 144 and main duct 140. Also in the first and third drying zones, heated air from main duct 130 flows through ducts 134, fittings 160, through the product from back to front, into plenum 162 from where it is exhausted through ducts 142 and main exhaust duct 138 (FIG. 8).

Figure 9:
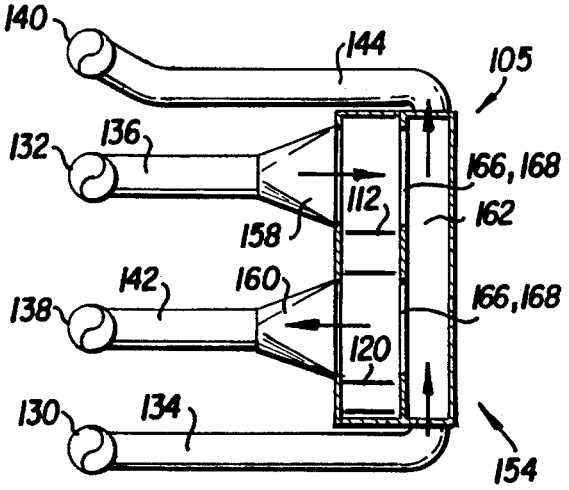
Figure 10:
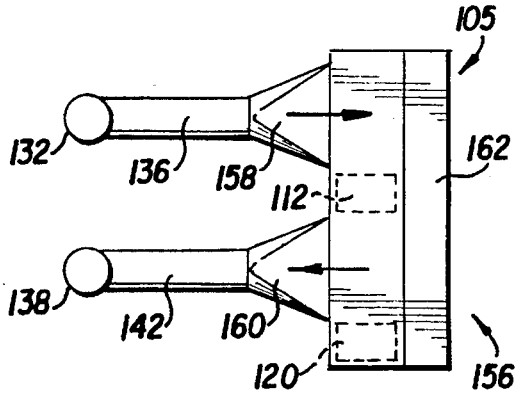

In the second and fourth drying zones, 150, 154, heated air from main hot air duct 130 flows through ducts 134 into plenum 162, passes through the product on conveyor 120 from front to back and is exhausted through fittings 160, ducts 142 and main exhaust duct 138 (FIG. 9). Also in the second and fourth drying zones, heated air from main hot air duct 132 flows through ducts 136, fittings 158, passes from back to front through the product on conveyor 112 and into plenum 162 from where it is exhausted through ducts 144 and main exhaust duct 140. In the fifth drying zone 156 (FIG. 10), heated air from main hot air duct 132 passes through duct 136, fitting 158, through the product on conveyor 112 from back to front into plenum 162 from where it passes from front to back through the product on conveyor 120 and is exhausted through fitting 160 and duct 142 into main exhaust duct 138. An exhaust duct 146 is connected by a funnel-shaped fitting 147 to the top of the inlet conveyor housing 170 for exhausting moist, humid air from the housing.

To permit the flow of heated air through the product P (FIG. 11), the intermediate wall 164 of the dryer section 105 is provided with openings 166 covered by screens or perforated plates 168. Flow rate through each opening may be in the 500–600 cfm range but will vary depending on the initial moisture content of the fuel elements and the substrates and on the desired final moisture content of those components. Control of the temperature and flow rate of the heated air admitted to the dryer section 105 may be accomplished by adjusting the flow rate and/or temperature of the steam admitted to heaters 34, 36 through pipes 35, 37 and by controlling blower motor speed or the dampers (not shown) associated with the ducts for admitting and exhausting heated air to the dryer section.

When the two-up fuel element/substrate product arrives at the inlet conveyor 104 of the second section 14, the moisture content of the carbonaceous fuel rod is still relatively high, e.g. , in the 20% to 27% range, and the moisture content of the paper overwrap is lower, e.g., in the range of 6% to 18%. As the product is transported by conveyors 112, 120 through the dryer section 105, the moisture content of the fuel rod and paper overwrap are reduced proportionally so that the moisture content of the extruded rod is reduced to about 10% to 18% depending upon a specified equilibrated moisture content of the final product as packaged. Advantageously, because the heated air passes first in one direction through the fuel element/substrate product then in the opposite direction through the product, a more uniform moisture content can be achieved from end-to-end of the product than if the heated air passed through the product in only one direction.

Figure 12:
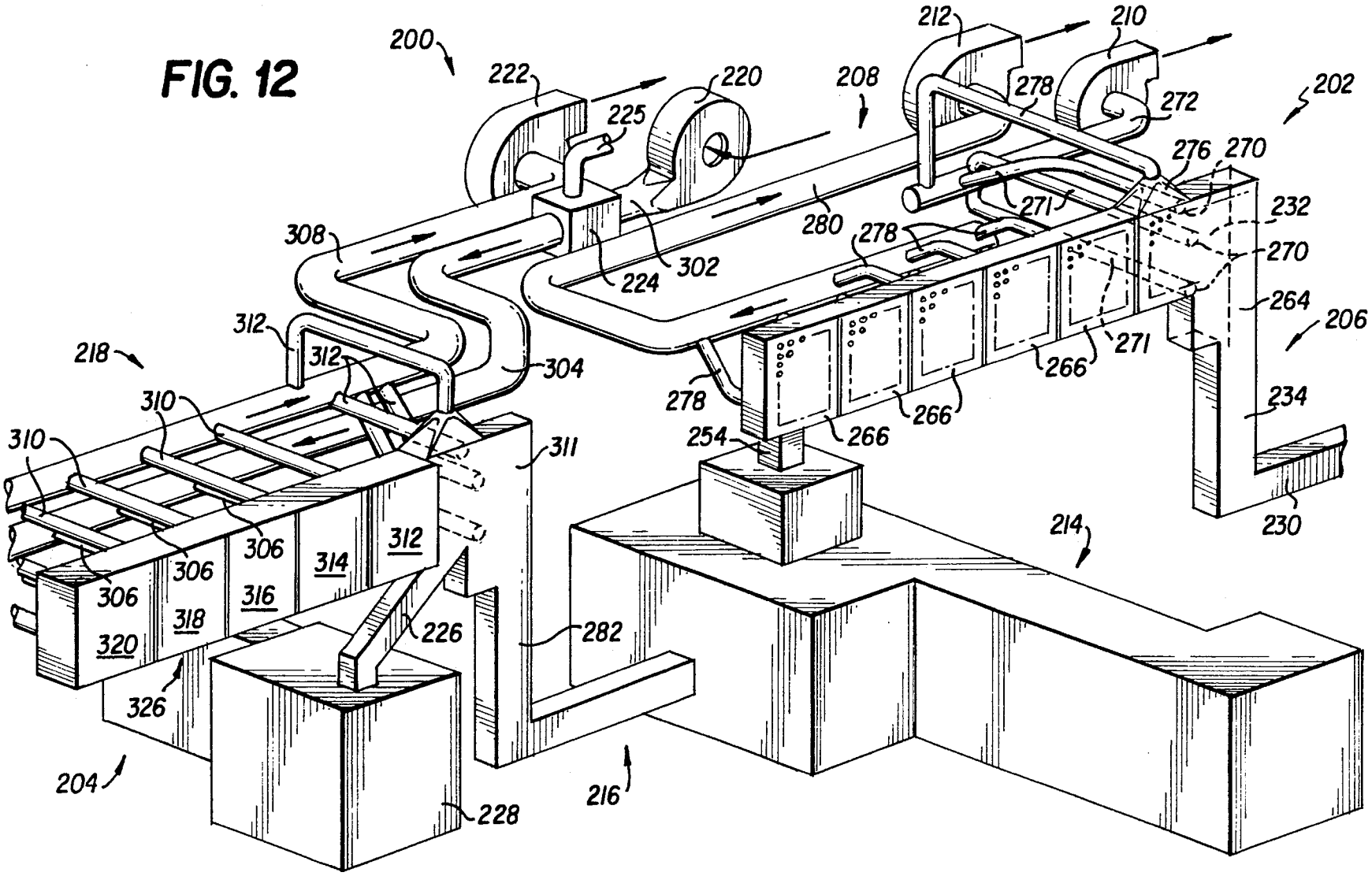
FIG. 12 is a perspective view of a second embodiment of the apparatus of the invention.
Figure 14:
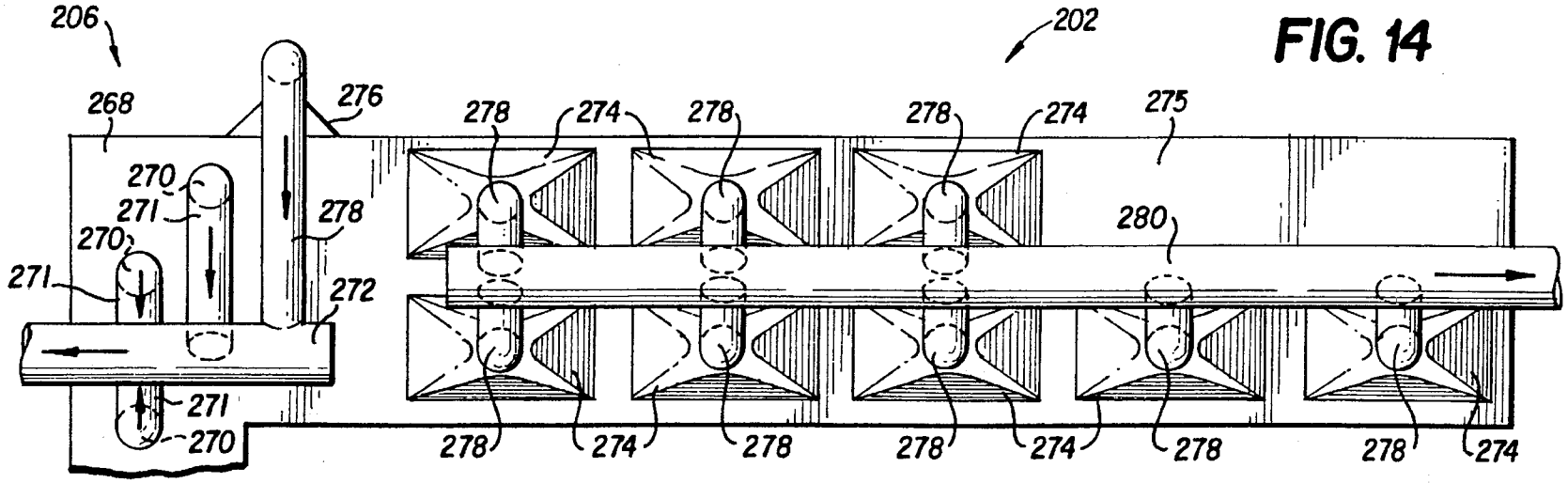
FIG. 14 is a rear elevation view showing the air exhaust ducts for the mass flow accumulator section of the FIG. 12 second embodiment.
Figure 16:
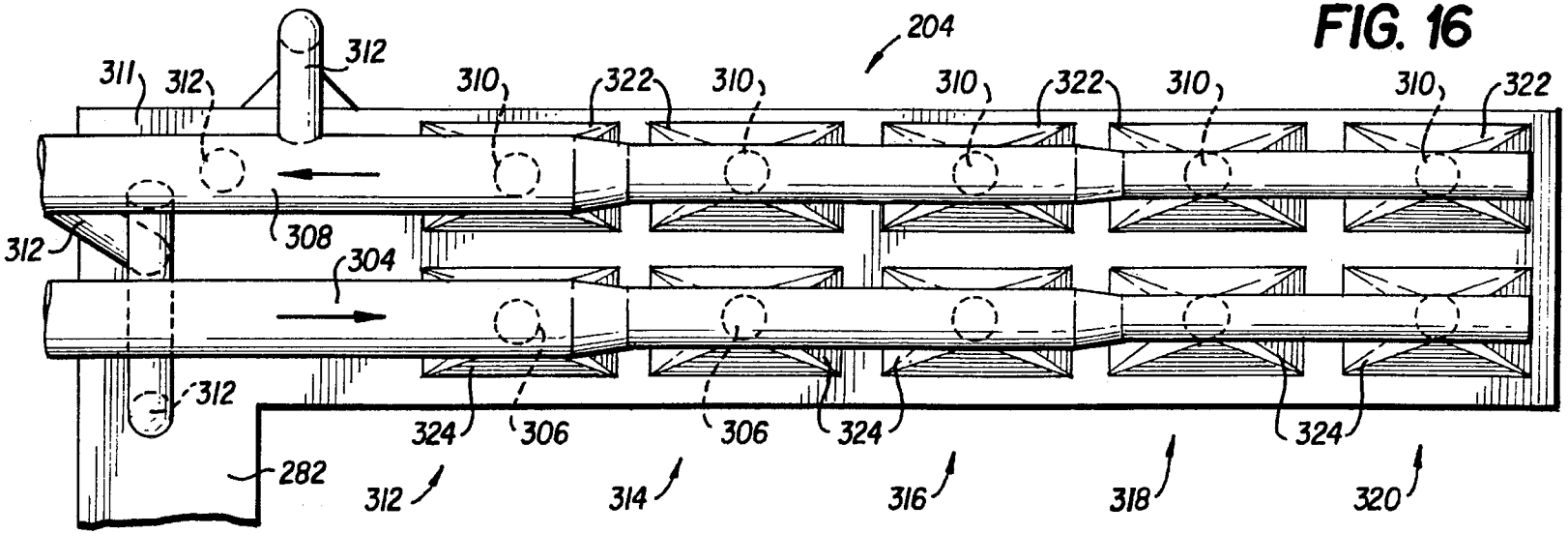
FIG. 16 is a rear elevation view showing the heated air and exhaust ducts for the dryer section of the FIG. 12 second embodiment.

Referring now to the second embodiment of the invention illustrated in FIGS. 12–18, there is shown in perspective view in FIG. 12 a simplified form of the moisture adjusting and drying apparatus of the invention designated generally by reference numeral 200. Like the first embodiment, the apparatus 200 is constructed in two sections designated generally by reference numerals 202 and 204. The first or upstream section comprises a moisture adjusting accumulator 202, such as a Resy mass flow accumulator modified in accordance with the present invention. The second or downstream section of the apparatus 200 comprises a hot air drying section 204, such as another Resy mass flow accumulator also modified in accordance with the invention.

The first section 202 includes an input conveyor section 206 which is connected to an upstream apparatus (not shown) for supplying fuel components to the apparatus 200 for processing. As in the first embodiment, the fuel components may be supplied from the output of the equipment disclosed in U.S. patent application Ser. No. 856,239 which output comprises the above-described extruded carbonaceous fuel rod. The fuel rod is cut into six-up fuel components which are deposited on the input conveyor 206.

The first section 202 is connected via ambient air manifold piping 208 to a pair of blowers or fans 210, 212 which draw unheated ambient air through the first section and over the fuel components therein. The ambient air may be heated if necessary. From the first or moisture-adjusting accumulator section 202, the fuel components are transported to a tipping apparatus 214, such as a Max R-1 or Max-2 tipper where they are cut into individual fuel elements which are combined two each with a two-up aerosol generator or substrate and conveyed as two-up fuel element/substrate units to the outlet conveyor 216 of the tipper 214.

Outlet conveyor 216 also comprises the inlet conveyor for the second section or hot air dryer section 204 of the apparatus 200. The second section 204 may be a modified Resy accumulator as described above. The second section 204 is connected via hot air manifold piping 218 to two blowers or fans 220, 222 and one heater 224. Blower 220 and heater 224 supply heated ambient air to the second section 204. Heater 224 is supplied with steam for air heating purposes via steam inlet line 225 from a source (not shown). Drying air is heated to a temperature in the range of about 110° F. to 160° F., and preferably to about 120° F. Blower 222 exhausts heated air from the second section 204. As in the first embodiment, such heated air carries along in the form of water vapor a substantial portion of the moisture content contained in the extruded fuel rods passing through the second section 204.

During passage of the two-up fuel element/substrate units through the second section 204, the difference in moisture content between the fuel element and the substrate is further reduced. The units may then be conveyed via a discharge chute 226 to, for example, an HCF tray filler 228 or to a conventional Resy accumulator or directly to cigarette making machinery. Eventually, the difference in moisture content between the fuel element and substrate will become zero, i.e., the moisture content of the fuel element/substrate combination will be equilibrated at a level that is in the desired range for packaging the completed cigarettes.

Now referring to FIGS. 12, 13, 14 and 17, the construction and operation of the first section 202 of the apparatus 200 will be described. The inlet conveyor 206 comprises lower and upper horizontal conveyor portions 230, 232 and a vertical conveyor portion 234. Conveyors 230, 232, 234 are formed by a pair of opposed conveyor belts 236, 238 each trained about a plurality of guide pulleys 240, one or more of which are driven by motors (not shown) so as to advance the fuel component product disposed between the confronting runs of the conveyor belts 236, 238 in the direction of the horizontal and vertical arrows 242.

From the upper horizontal portion 232 of the inlet conveyor 206, the fuel component product flows downwardly through a receiving chute 244 and onto a lower horizontal conveyor belt 246 which is trained about pulleys 248 (only one shown) driven by a motor (not shown). The upper horizontal run 250 of the conveyor belt 246 is guided over a stationary plate member 252 so as to support the mass of fuel component product carried downstream by the conveyor belt 246. At the downstream end of the conveyor 246, the fuel component product passes downwardly through a discharge chute 254 to the tipping apparatus 214 (FIG. 12).

The upper portion of the mass flow section 202 comprises an accumulator bank 256 with an upper horizontal conveyor belt 258 trained about pulleys 260 (only one shown) and a movable pusher member 262 which moves back and forth horizontally. Movement of the pusher member 262 toward the downstream end of the mass flow section will accumulate the fuel component product on the upper conveyor 258, for example, when product flow downstream of the first section 202 is stopped or interrupted for any reason. When flow resumes, the pusher member 262 moves from its downstream position toward its position at the upstream end of the upper conveyor belt 258.

The front surfaces of the input conveyor section 206 and the mass flow section 202 are provided with perforated plates or screens 264, 266 to permit the inflow of ambient air into those sections. Such air flow is generated by blowers 210, 212 creating a suction in air manifold piping 208 which is connected to the sections 206, 202 in the piping arrangement shown in FIGS. 12, 14 and 17.

Attached to the rear wall 268 of the input conveyor section 206 is one or more suction openings 270 which are connected via pipes 271 and main duct 272 to blower 210 so as to draw ambient air through perforated plates 264 across the fuel component product in the input conveyor section 206. The capacity of blower 210 is about 1500 to 1600 cfm but may be adjusted by blower motor speed control or by dampers (not shown) to a desired flow rate depending on the throughput of the apparatus, the moisture content of the extruded fuel rod in the incoming fuel component product and the desired moisture content of the fuel component at the discharge chute 254 of the first section 202.

A plurality of funnel-shaped duct fittings 274 are secured to the rear wall 275 of mass flow section 202 and one funnel-shaped duct fitting 276 is secured to the top of the mass flow section at the outlet or discharge of the upper horizontal conveyor 232 of the input conveyor section 206. Each of the fittings 274, 276 is connected by individual piping 278 to a main suction duct 280 which is, in turn, connected to blower 212. Blower 212 draws ambient air through the perforated plates 266 of the mass flow section 202 and across the fuel component product disposed therein in the direction shown by the arrows in FIG. 17. Blower 212 has a capacity similar to that of blower 210 and may be adjusted in the same manner as blower 210.

When the six-up fuel components arrive at the lower horizontal conveyor 230 of the input conveyor 206, the moisture content of the extruded carbonaceous fuel rod contained in the fuel component product is relatively high, e.g., about 30% to 40%, and the moisture content of the circumscribing resilient layer and paper overwrap is relatively low, e.g., in the 6% to 18% range, and preferably about 8% to 12%. As in the first embodiment, to avoid any excessive migration of moisture from the extruded fuel rod to the overwrap while at the same time maintaining a relatively high moisture content of the fuel rod to insure ease of cutting the rod during further processing downstream, unheated ambient air is used in the first section 202. The flow rate of the unheated air is adjusted in relation to the throughput of fuel component product and the initial moisture content of the extruded rod so that (1) the moisture content of the overwrap paper is maintained below about 18% to avoid swelling problems and (2) the moisture content of the extruded rod does not fall below about 18% and preferably is maintained at about 22% to 30% for optimum cutting.

Referring again to FIG. 12, after the six-up fuel components are discharged from the first section 202 through discharge chute 254, they are received in the tipping apparatus 214 where they are each cut into six fuel elements of equal length. Each pair of fuel elements is positioned with one element at opposite ends of a substrate unit and the combination is overwrapped with tipping paper to form a two-up fuel element/substrate unit which exits the tipper 214 and passes to the outlet conveyor 216.

Referring now to FIGS. 12, 15, 16 and 18, the construction and operation of the second section or hot air drying section 204 of the apparatus 200 will be described. From the outlet conveyor 216 of the tipper apparatus 214, the two-up fuel element/substrate units are conveyed by an inlet conveyor 282 similar to input conveyor 234 to the dryer section 204 where they are discharged from between the conveyor belts 284, 286 of the inlet conveyor onto an inclined support plate 288. The units flow down support plate 288 onto the upper run of a conveyor belt 290 located in the upper part of the dryer section 204. Conveyor belt 290 is trained between a pair of pulleys 292 at least one of which is driven by a motor (not shown). The upper conveyor run is guided over a stationary support plate 294 so as to support the mass of fuel element/substrate units thereon.

At the downstream end of the upper conveyor 290, the units flow downwardly into the lower part of the dryer section 204 and onto the upper run of a lower conveyor belt 296 which is trained about pulleys 298 at least one of which is motor-driven. Like conveyor 290, the upper run of conveyor 296 is guided over a stationary support plate 300. In the dryer section 204, no accumulator section is provided as in the mass flow section 202. Accordingly, all the product flows along both conveyors, first over conveyor 290 from right to left as viewed in FIG. 15 and then over conveyor 296 from left to right as viewed in FIG. 15. At the downstream end of conveyor 296, the units are guided down inclined discharge chute 226 from which they are discharged into an HCF tray filler 228 (FIG. 12).

Heated air is flowed over the units passing through the second section 204 by means of the hot air manifold piping 218, blowers 220, 222 and heater 224 in the following manner. Blower 220 intakes ambient air and discharges it into main duct 302 from which it passes through heater 224 where it is heated to a temperature in the range of 110° F. to 160° F., and preferably about 120° F. From heater 224, the heated air flows through main hot air duct 304 and into smaller hot air supply ducts 306 which are connected to the dryer section 204 in the manner described below. Exhaust blower 222 is connected to the dryer section 204 by main hot air exhaust duct 308 and smaller hot air exhaust ducts 310. Main hot air exhaust duct 308 is also connected to smaller air exhaust ducts 312 which draw unheated air through the top and rear of the housing 311 of the inlet conveyor 282 in the same manner as that described above in connection with the mass flow section 202. The blowers 220, 222 have the same capacity as the blowers 210, 212 (1500 cfm to 1600 cfm) and, like the blowers 210, 212, may be adjusted by a motor control or by dampers.

Like the first embodiment, the dryer section 204 has five drying zones 312, 314, 316, 318, 320 into which the heated air is introduced and exhausted. It has been found that more uniform distribution of the heated air and consequently a more uniform drying of the fuel element/substrate units can be achieved by alternately passing the heated air along the units first from one end and then from the other end. This is accomplished by appropriate connection of the hot air supply and exhaust ducts to the five drying zones 312–320.

Each drying zone is provided at the rear of the dryer section 204 with a pair of funnel-shaped duct fittings 322, 324 which confront the product supported on conveyor belts 290, 296 respectively. The front of the dryer section 204 is provided with a plenum 326 that extends the entire length of the five drying zones. In each of the drying zones 312–320, heated air from main hot air duct 304, ducts 306 and fittings 324 passes from back to front through the product on conveyor 296, enters the plenum 326, passes upwardly, then horizontally through the product on conveyor 290 from front to back and is exhausted through fittings 322, ducts 310 and main duct 308 (FIG. 18). The exhausted hot air is combined with unheated air drawn from the inlet conveyor 282 via ducts 312 by blower 222.

Figure 11:
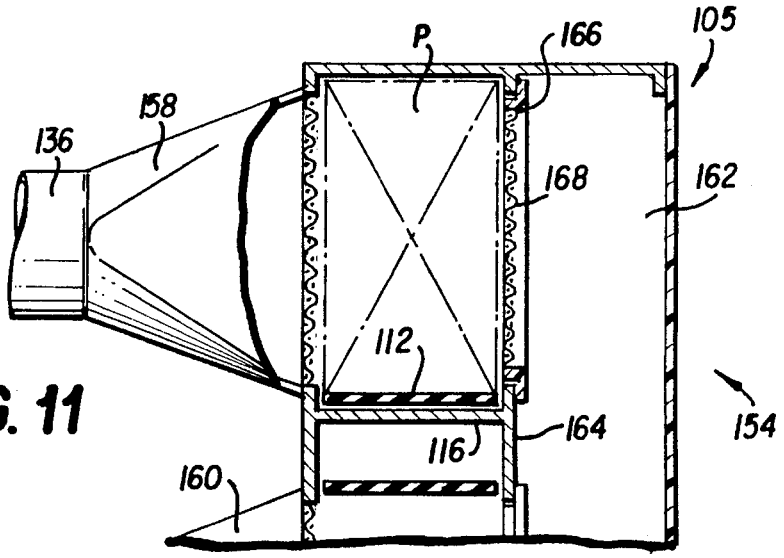
FIG. 11 is a cross-sectional view showing plenum details of the dryer section.

To permit the flow of heated air through the product, the intermediate wall 328 of the dryer section 204 is provided with openings 330 covered by screens or perforated plates (not shown) as shown in FIG. 11 of the first embodiment. Flow rate through each opening may be in the 500–600 cfm range but will vary depending on the initial moisture content of the fuel elements and the substrates and on the desired final moisture content of those components. Control of the temperature and flow rate of the heated air admitted to the dryer section 204 may be accomplished by adjusting the flow rate and/or temperature of the steam admitted to heater 224 through pipe 225 and by controlling blower motor speed or the dampers (not shown) associated with the ducts for admitting and exhausting heated air to the dryer section.

When the two-up fuel element/substrate product arrives at the inlet conveyor 282 of the second section 204, the moisture content of the carbonaceous fuel rod is still relatively high, e.g. , in the 20% to 27% range, and the moisture content of the paper overwrap is lower, e.g., in the range of 6% to 18%. As the product is transported by conveyors 290, 296 through the dryer section 204, the moisture content of the fuel rod and paper overwrap are reduced proportionally so that the moisture content of the extruded rod is reduced to about 10% to 18% depending upon a specified equilibrated moisture content of the final product as packaged. Advantageously, because the heated air passes first in one direction through the fuel element/substrate product then in the opposite direction through the product, a more uniform moisture content can be achieved from end-to-end of the product than if the heated air passed through the product in only one direction.

From the foregoing, it will be appreciated by those skilled in the art that the present invention provides a particularly effective and advantageous process and apparatus for solving several problems associated with the manufacture of smoking articles incorporating extruded carbonaceous fuel rods.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. Apparatus for controlling the moisture content of a carbonaceous fuel component used in the manufacture of smoking articles comprising:

mass flow accumulator means for receiving and accumulating a plurality of said fuel components;

first means connected to said accumulator means for flowing unheated air over said fuel components to maintain the moisture content of said fuel, components at a predetermined level;

dryer means disposed downstream of said accumulator means for receiving said components from said accumulator means;

means interposed between said accumulator means and said dryer means for cutting said fuel components into a plurality of individual fuel elements and for combining said fuel elements with smoking article components; and second means connected to said dryer means for flowing heated air over the fuel components in said dryer means to dry the fuel components to a predetermined level of moisture content.

2. Apparatus according to claim 1, including means located upstream of said accumulator means for supplying fuel components to said accumulator means, said supplying means including an extruder for extruding a continuous carbonaceous fuel rod, means for wrapping said fuel rod with a resilient layer and a paper overwrap and means for cutting the overwrapped fuel rod into a plurality of fuel components.

3. Apparatus according to claim 2, wherein said supplying means further includes an input conveyor connected to said accumulator means, said means for flowing unheated air being connected to said input conveyor for flowing unheated air therethrough.

4. Apparatus according to claim 1, wherein said unheated air flowing means comprises unheated air manifold piping connected to said accumulator means and a blower connected to said piping, said accumulator means including a perforate housing through which air is drawn into said accumulator means, said blower exhausting said air from said accumulator means through said piping.

5. Apparatus according to claim 1, wherein said heated air flowing means comprises heated air manifold piping and exhaust manifold piping connected to said dryer means, a first blower connected to said heated air manifold piping for drawing air into said heated air manifold piping and heating means for heating the air drawn into such piping, a second blower connected to said exhaust manifold piping for drawing air from the dryer means.

6. Apparatus according to claim 1, wherein said dryer means includes upper and lower conveyors for conveying said fuel components through said dryer means, said heated air flowing means being connected to said dryer means such that heated air flows through the fuel components on the upper conveyor in a first direction and through the fuel components on the lower conveyor in a second direction opposite the first direction.

7. Apparatus according to claim 6, wherein said second means comprises a plenum disposed adjacent said dryer means, a blower connected to said plenum for introducing air to said plenum, a heater for heating the air introduced to said plenum, and a blower for exhausting spent heating air from said plenum.

8. Apparatus according to claim 1, wherein said fuel components have longitudinal axes arranged substantially parallel to one another, said first and second flowing means being arranged to flow said unheated and heated air along the longitudinal axes of the fuel components.

9. Apparatus according to claim 1, wherein said cutting and combining means includes an output conveyor for supplying fuel elements to said dryer means, said output conveyor being connected to and comprising the input conveyor for said dryer means.

10. A method of adjusting and controlling the moisture content of carbonaceous fuel components used in the manufacture of smoking articles comprising the steps of:

accumulating a plurality of said fuel components having a given initial moisture content;

flowing air over said fuel components to reduce the moisture content thereof from said given moisture content;

cutting said fuel components into individual fuel elements;

conveying said fuel elements to a dryer; and flowing heated air over said fuel elements in said dryer to further reduce the moisture content of the fuel elements to a predetermined level for further processing.

11. The method of claim 10, wherein each of said fuel components comprises an extruded carbonaceous fuel rod that is extruded at an initial moisture content in the range of about 30% to about 40%, a resilient jacket and a paper overwrap having an initial moisture content in the range of about 6% to about 18%, said step of flowing air over said fuel components includes flowing a sufficient volume of unheated air over said fuel components so as to maintain the moisture content of said overwrap below about 18% and the moisture content of the extruded rod at a moisture content in the range of about 22% to about 30%.

12. The method of claim 11, wherein the moisture content of the extruded rod is maintained in the range of about 22% to about 30% during the step of cutting said fuel components.

13. The method of claim 12, wherein during the step of cutting said fuel components the moisture content of said extruded rod is maintained in the range of about 25% to about 30% and the moisture content of the paper overwrap is maintained in the 6% to 18% range.

14. The method of claim 10, including the step of combining the individual fuel elements with another smoking article component.

15. The method of claim 10, wherein said step of flowing heated air over said fuel elements includes flowing a sufficient volume of heated air at a sufficient temperature to reduce the difference in moisture content between the extruded rod and the paper overwrap.

16. The method of claim 15, wherein said heated air is heated to a temperature in the range of from about 110° F. to about 160° F.

17. The method of claim 16, wherein said heated air has a temperature of about 120° F.

18. The method of claim 10, wherein said fuel components and fuel elements have longitudinal axes, said air being flowed over said fuel components and fuel elements in a direction substantially parallel with said axes.

19. The method of claim 18, wherein said unheated air is flowed over said fuel components in one direction and said heated air is flowed over said fuel elements in a first direction and then in a second direction opposite said first direction.

20. The method of claim 19, including the step of exhausting spent heated air from said dryer.

21. The method of claim 10, including the step of conveying the fuel elements through said dryer from an upstream to a downstream end thereof and then from said downstream end to said upstream end thereof and discharging said fuel elements from the upstream end thereof.

22. The method of claim 21, including the step of flowing heated air through said fuel elements in opposite directions.

23. The method of claim 10, wherein said fuel components are accumulated in a mass flow accumulator having a perforate portion, said step of flowing air including the steps of drawing unheated ambient air through said perforate portion over said fuel components and exhausting said unheated ambient air from said accumulator.

24. The method of claim 10, wherein the step of flowing air over said fuel components includes the step of heating the air prior to said flowing step.

25. The method of claim 10, wherein the air flowed over said fuel components is unheated ambient air.

* * * * *